United States Patent [19]

Okada et al.

[11] Patent Number: 4,696,856

[45] Date of Patent: Sep. 29, 1987

[54] PRESSURE-SENSITIVE RECORDING MATERIAL

[75] Inventors: Yoshio Okada; Nobuo Ahiko; Yuriko Igarashi, all of Iwaki, Japan

[73] Assignee: Kureha Kagaku Kogyo Kabushiki Kaisha, Tokyo, Japan

[21] Appl. No.: 770,788

[22] Filed: Aug. 29, 1985

[30] Foreign Application Priority Data

Sep. 7, 1984 [JP] Japan ..... 59-186590
Sep. 20, 1984 [JP] Japan ..... 59-197551

[51] Int. Cl.[4] ..... B41M 5/00

[52] U.S. Cl. ..... 428/321.5; 106/23; 503/227; 427/146; 428/206; 428/207; 428/323; 428/402.2; 428/402.21; 428/402.22; 428/914

[58] Field of Search ..... 346/215, 227, 213; 428/321.3, 321.5, 206, 207, 323, 402.2, 402.21, 402.22, 914; 106/20, 23; 427/146, 153

[56] References Cited

U.S. PATENT DOCUMENTS 3,934,069 1/1976 Atzrott et al. ..... 428/321.5

FOREIGN PATENT DOCUMENTS 764893 8/1971 Belgium ..... 428/321.3

*Primary Examiner*—Bruce H. Hess
*Attorney, Agent, or Firm*—Cushman, Darby & Cushman

[57] ABSTRACT

Disclosed herein is a pressure-sensitive recording material including such a sheet excellent in the durability and definition of the recorded images transcribed on another sheet, which is produced by the process comprising the step of applying the microcapsules encapsulating minute particles of a pigment dispersed in a solution of an adhesive and optionally, an oil-soluble colored dyestuff dissolved in the solvent onto a supporting material such as sheet, and a process for producing the same.

19 Claims, No Drawings

PRESSURE-SENSITIVE RECORDING MATERIAL

BACKGROUND OF THE INVENTION

The present invention relates to a pressure-sensitive recording material including such a sheet excellent in the durability and definition of the recorded images transcribed on another sheet, which is produced by the process comprising the step of applying the microcapsules encapsulating minute particles of a pigment dispersed in a solution of an adhesive and optionally, an oil-soluble coloured dyestuff dissolved in a solvent onto a supporting material such as sheet, and a process for producing the same.

Hitherto, as the most generalized pressure-sensitive recording material including a sheet, there has been known the so-called "carbonless recording paper" which utilizes the coloured product formed by the reaction between a colourless dyestuff and a colour developer.

Such carbonless paper for pressure-sensitive recording is constituted by the combination of a sheet of paper (a supporting material) having its undersurface of which has been coated with the microcapsules containing a solution of the colourless dyestuff in a solvent (the thus prepared sheet of paper being referred to as CB sheet) and another sheet of paper having its upper surface of which has been coated with the colour developer for forming the coloured product (the thus prepared sheet of paper being referred to as CF sheet).

Furthermore, in the case where a plurality of recorded copies are requested in the above-mentioned system, such pressure-sensitive recording paper is constituted by further combining a sheet of paper having its upper surface of which has been coated with the colour-developer and its undersurface of which has been coated with the microcapsules containing a solution of the colourless dyestuff in a solvent (the thus prepared sheet of paper being referred to as CFB sheet) with the above-mentioned two kinds of sheets, i.e., CB sheet and CF sheet (Japanese Patent Publication No. 49-2124 (1974) and U.S. Pat. No. 3,836,383).

The pressure-sensitive recording paper according to the above-mentioned system is excellent in its performances in copying and recording and is broadly utilized for those purposes.

However, on the other hand, its construction is complicated due to the use of many kinds of chemicals, and because of the use of coloured product formed by the utilization of chemical reaction, the sheet of paper is apt to be deteriorated by contact with water and chemicals.

Accordingly, much attention is necessary for the preservation of the pressure-sensitive recording material and/or the maintenance of the developed and recorded images on another sheet material. If anything should happen, the important recorded image would disappear from the sheet of paper resulting in incapability of playing the role as the material for recording. The same phenomenon of the disappearance of the coloured image is also caused by exposure to light and accordingly, the handling of such a kind of pressure-sensitive recording material including a sheet becomes complicated furthermore.

As another kind of pressure-sensitive recording material including a sheet, the so-called "carbon paper" has been known. Such a kind of pressure-sensitive recording material has a pigment weakly held on the undersurface of a supporting material (a sheet of paper) by a wax, and the image is transcribed on another sheet of paper (underlaid sheet of paper) a face of which has not been coated with specified chemical with a pressure applied on the uppersurface of the supporting material.

Such a pressure-sensitive recording material including a sheet has a merit of possibly forming the images on an ordinary sheet of paper (namely, a sheet of paper a face of which has not been coated with specified chemical. However, on the other hand, because of the very weak holding of the pigment on the surface of the sheet of paper (the supporting material), stains are apt to be caused during the preservation and in the case of handling thereof. In addition, since the pigment is apt to adhere to the hands and clothes of the persons handling the material including a sheet, an excessive attention should be taken in the handling and the preservation of the materials including a sheet before and after the use thereof. Furthermore, the transcribed images are only weakly held on the surface of another sheet, and the images stain the circumference thereof by friction of the transcribed surface not only to deteriorate the quality of the thus transcribed images but also to cause the misreading thereof.

In addition, in the case of using the pressure-sensitive recording material disclosed in Japanese Patent Application Laid-Open No. 57-98390, which is produced by applying the microcapsules containing a solution of an oil-soluble coloured dyestuff on the undersurface of the supporting material, it is not possible to obtain the images which are stable for a long period because of the poor light-stability of the image.

As has been described above, the pressure-sensitive recording material including a sheet produced by the conventional techniques does not exhibit sufficient performances concerning the durability and definition of the recorded images, and in addition, the conventional pressure-sensitive recording material have a problem also of instability before colour-development. For instance, in the case of "carbonless recording paper", an entire colour-development is caused on the whole surface of the paper by exposure to light, and in the case of carbon paper, the paper is stained by heat. Accordingly, much attention has been necessary in the handling of the recording paper before colour development and in the preservation and handling of another paper holding the recorded images.

Namely, strongly demanded is the offer of the pressure-sensitive recording material including such a sheet, which can be easily preserved and handled and gives a stabilized, recorded images, however, such an object has not been attained.

In addition, recently, it has become regarded as important to read the recorded images by using an optical instrument, thereby improving the efficiency of information-treatment and accordingly, it has been strongly demanded to raise the durability and preservability of the recorded images themselves as well as the accuracy in reading the recorded images by such an instrument.

The first object of the present invention is to provide the pressure-sensitive recording material including such a sheet excellent in the durability and the preservability of the recorded images transcribed on another sheet and high in accuracy in reading the recorded images by the optical instrument.

The second object of the present invention is to provide the process for producing the above-mentioned pressure-sensitive recording material including such a sheet.

As a result of the present inventors' studies for solving the above-mentioned problems, the present inventors have found that the pressure-sensitive recording material including such a sheet excellent in the durability and preservability of the recorded images and high in the accuracy in reading by the optical instrument and can be handled easily without any complexity is available by the use of the sheet of paper coated with the microcapsules containing the minute particles of a pigment dispersed in a solution of an adhesive dissolved in a hydrophobic solvent as the core material thereof or the microcapsules containing the microcapsules of the pigment dispersed in a solution of both the adhesive and an oil-soluble coloured dyestuff dissolved in a hydrophobic solvent as the core material, and on the basis of the finding the present invention has been attained.

SUMMARY OF THE INVENTION

In an aspect of the present invention, there is provided a pressure-sensitive recording material including such a sheet comprising a supporting material such as sheet a face of which is coated with microcapsules encapsulating minute particles of a pigment dispersed in a solution of an adhesive dissolved in a hydrophobic solvent and optionally further an oil-soluble coloured dyestuff as a core material and another sheet, the face of the supporting material which is coated with the microcapsules facing the face of the sheet.

In a second aspect of the present invention, there is provided a process for producing a pressure-sensitive recording material including such a sheet, comprising preparing microcapsules encapsulating minute particles of a pigment dispersed in a solution of an adhesive dissolved in a hydrophobic solvent and optionally further an oil-soluble coloured dyestuff as a core material, and applying a slurry of the microcapsules on face of a supporting material such as sheet constituting the pressure-sensitive recording material.

DETAILED EXPLANATION OF THE INVENTION

The characteristic feature of the pressure-sensitive recording material including such a sheet according to the present invention is that the pressure-sensitive recording material including such a sheet has been produced by applying (1) the microcapsules encapsulating the minute particles of a pigment dispersed in a solution of an adhesive dissolved in a hydrophobic solvent or (2) the microcapsules encapsulating the minute particles of the pigment dispersed in a solution of both the adhesive and an oil-soluble coloured dyestuff in a hydrophobic solvent on a surface of a supporting material such as sheet (usually a sheet of paper).

Namely, according to the present invention, (1) the minute particles of the pigment and the adhesive are released from the microcapsules applied onto the surface of the supporting material (referred to as the upper sheet) (usually, a sheet of paper is used as the supporting material) in the case of destruction of the microcapsules by the external pressure, and the minute particles of the pigment and the adhesive are transferred to the surface of another supporting material (referred to as another sheet) disposed under the upper sheet and are firmly fixed on the surface of another sheet via the adhesive, or (2) both the minute particles of the pigment, the adhesive and the oil-soluble coloured dyestuff are released from the microcapsules applied onto the surface of the supporting material (upper sheet) in the case of destruction of microcapsules by the external pressure, and the minute particles of the pigment, the adhesive and the oil-soluble coloured dyestuff are transferred to the surface of another sheet and firmly fixed thereon via the adhesive.

Of the raw materials used for exhibiting the efficacy of the present invention, the pigment is selected from those insoluble or sparingly soluble in a hydrophobic solvent used for dissolving the adhesive or both the adhesive and the oil-soluble coloured dyestuff therein and deep in colour, the preferable material being minute particles of carbon, particularly preferable being "carbon black". Particularly important is the size of the particles of the pigment, and it is less than 50 nm, and preferably less than 30 nm. In the case where the size is over 50 nm, the transfer of the particles from the destroyed microcapsules is not effected favorably for obtaining a sufficient colour density of the images.

In addition, it is necessary that the content of the minute particles of the pigment in the core material is less than 25% by weight based on the core material, and in the case of over 25% by weight, a sufficient transfer of the minute particles of a pigment from the destroyed microcapsules is not available. Preferably, the pigment in the core material is contained in the range of from 5 to 20% by weight based on core material.

On the other hand, the adhesive may be anything which dissolves in the hydrophobic solvent and is able to firmly fix the minute particles of the pigment onto another sheet after the destruction of the microcapsules and accordingly, is not specifically limited, however, polystyrene, polyacrylates, polymethyacrylates, low-molecular weight polyethylene, ethylcellulose, natural rubbers, chloroprene rubbers and the like may be mentioned. The weight ratio of the adhesive which fixes the minute particles of the pigment to the surface of another sheet in a stabilized situation to the minute particles of the pigment is suitably in the range of from 8:2 to 2:8.

Further, it is preferable that the adhesive in the core material is contained in the range of from 1.5 to 30% by weight based on the core material of the microcapsule.

As the hydrophobic solvent which can be used according to the present invention, aromatic solvents, for instance, alkylbenzenes such as toluene, xylene, ethylbenzene, mesitylene, cymene, cumene and the like, alkylnaphthalenes such as methylnaphthalene, ethylnaphthalene, dimethylnaphthalene, diethylnaphthalene, isopropylnaphthalene, diisopropylnaphthalene, methylisopropylnaphthalene, methylbutylnaphthalene, amylnaphthalene and the like, and alkylbiphenyls such as methylbiphenyl, dimethylbiphenyl, ethylbipheny, diethylbiphenyl, isopropylbiphenyl, diisopropylbiphenyl, butylbiphenyl and the like may be exemplified.

In addition to these hydrocarbons, hydrogenated aromatic hydrocarbons such as cyclohexane, tetralin, decalin and the like and esters such as diethyl phthalate, di-isopropyl phthalate, dibutyl phthalate, dioctyl phthalate, diethyl sebacate, dibutyl sebacate, diethyl adipate, ethyl benzoate and the like may be used as the solvent.

Although the above-mentioned solvent is used suitably singly or as a mixture of more than two kinds thereof, any other solvent(s) may be used for the purpose of adjusting the viscosity of the solution without any difficulty and without losing the efficacy of the present invention.

In addition, according to the present invention, in order to further improve the colour density, continuity, definition and durability of the recorded images on another sheet in pressure-sensitive recording, an oil-soluble coloured dyestuff may be optionally included as a component of the core material of the microcapsule.

As the oil-soluble coloured dyestuff for use in the present invention, those which are adsorbed onto the minute particles of the pigment, thereby amplifying density of the coloured images, particularly the blackness thereof has an absorption band in the range of wave lengths of from 530 to 740 nm are preferably suitable, and the following materials of the oil-soluble coloured dyestuff may be mentioned.

Those derivatives of anthraquinone such as
ORIENT OIL VIOLET #730,
IKETON VIOLET EXTRA and
SUDAN BLUE G EXTRA.
Those derivatives of triarylmethane such as
METHYLVIOLET 2B 125% and
VICTORIA BLUE F4R.
Those derivatives of phthalocyanine such as
ORIENT OIL BLUE BOS, etc.

Among them, the particularly desirable are SUDAN BLUE G EXTRA and ORIENT OIL BLUE BOS, however, ORIENT OIL BLUE II N may be favorably used.

The oil-soluble coloured dyestuff, optionally used as a component of the core material of the microcapsule according to the present invention is contained preferably in the range from 0.15 to 10% by weight based on the core material.

The microcapsules encapsulating as a core material, the minute particles of the pigment, the adhesives and the solvent thereof, and optionally the above-mentioned oil-soluble coloured dyestuff may be prepared by the publicly known process (European Patent Publication No. 0046415). Although the material constituting the membrane of the microcapsule is not specifically limited from the view point of the transferring property of the minute particles of the pigment, polyurethane and amino resin are the most preferable material for that purpose.

As the supporting material such as sheet (the upper sheet) for use according to the present invention, particularly a sheet of high quality paper, a sheet of synthetic paper, a coated paper and a coated film may be exemplified.

As has been described, the material including such a sheet for pressure-sensitive recording according to the present invention is produced by applying the microcapsules encapsulating the minute particles of a pigment, the adhesive and optionally an oil-soluble coloured dyestuff onto a surface of a supporting material such as sheet of paper and accordingly, the pressure-sensitive recording material can be easily preserved and handled, and in the case of actually using the pressure-sensitive recording material including such a sheet according to the present invention, the microcapsules are broken by applying an external pressure such as that of a pencile, and the minute particles of the pigment are released from the thus broken microcapsules and transferred to the surface of another sheet and then fixed firmly thereon by the adhesive which has been released together with the pigment.

Accordingly, when the pressure-sensitive recording material including such a sheet according to the present invention is used, the stabilized, recorded images excellent in the durability are easily obtained and the thus obtained, recorded images can be read in a high accuracy by an optical instrument.

The present invention will be explained more in detail while referring to Examples, Comparative Examples and Reference Examples as follows.

EXAMPLE 1

1-1: Preparation of two prepolymers

After adjusting the pH of 270 g of aqueous 37% solution of formaldehyde (hereinafter referred to as formalin) by the addition of aqueous 2% solution of sodium hydroxide to 8.5, it was mixed with 70 g of melamine, and the mixture was brought into reaction while stirring the mixture at 70° C. Just after confirming the complete dissolution of melamine in the reaction mixture, 360 g of water were added to the reaction mixture, and the mixture was stirred for 3 min to obtain an aqueous solution of a prepolymer of melamine-formaldehyde resin (hereinafter referred to as M6F prepolymer, M6F meaning that the molar ratio of melamine to formalidehyde is 1:6 in the prepolymer).

Separately, after adjusting the pH of 146 g of formalin by the addition of triethanol amine to 8.5, it was mixed with 60 g of urea, and the mixture was brought into reaction for 1 hour at 70° C. to prepare an aqueous solution of a prepolymer of urea-formaldehyde resin (hereinafter referred to as U 1.8 F prepolymer).

1-2: Preparation of an oily dispersion

Into 670 g of diisopropylnaphthalene, 50 g of polystyrene (DICELASTYRENE®, made by DAINIPPON INK Chem. Co., Ltd.) were dissolved and in the obtained solution 85 g of carbon black (made by MITSUBISHI KASEI Co., Ltd., #33, size of 28 nm) was dispersed.

1-3: Microcapsulation

A mixture consisting of 280 g of M6F prepolymer (refer to 1-1), 140 g of U 1.8 F prepolymer (refer to 1-1), 56 g of the aqueous solution of the water-soluble cationic urea resin (Uramine® P-1500, made by URAMINE Ind. Co. Ltd.), 560 g of water and 28 g of triethanolamine was adjusted to pH of 5.2 by the addition of aqueous 10% solution of citric acid, and by admixing the mixture with 28 g of aqueous 10% solution of NEOPELEX® No. 6 (sodium dodecylbenzenesulfonate, made by KAO-ATLAS Co., Japan) a solution named as A-liquid was obtained.

Into the thus prepared A-liquid, 700 ml of the oily dispersion were dispersed so that the mean diameter of the oily dispersed particles is about 3–15 micrometers. The thus obtained aqueous dispersion was brought into reaction for 25 hours while gently stirring the aqueous dispersion and maintaining the aqueous dispersion at a temperature of 30° C., and after adding aqueous 10% solution of citric acid to the aqueous dispersion to adjust the pH of the dispersion to 3.0, the aqueous dispersion was continuously reacted under stirring to obtain a slurry of microcapsules encapsulating an oily dispersion of carbon black together with the adhesive.

To slurry of the thus obtained microcapsules, 5% by weight of polyvinyl alcohol (KURAREPOVAL®105, made by KURARE Co., Ltd.) based on the slurry was added, and the mixture was applied onto a surface of a sheet of high quality paper of 50 g/m$^2$ at an applying rate of 3 g/m$^2$ (by weight of the microcapsules). By drying the thus coated sheet of paper, a pressure-sensitive recording paper according to the present invention was obtained.

EXAMPLE 2

In the same manner as in Example 1 except for using a 50:50 (by weight) mixture of xylene and methylnaphthalene instead of diisopropylnaphthalene in Example 1, a pressure-sensitive recording material of the present invention was obtained.

EXAMPLE 3

In the same manner as in Example 1 except for using ethylcellulose (made by Hercules Co., grade of N-4) instead of polystyrene in Example 1, a pressure-sensitive recording material of the present invention was obtained.

COMPARATIVE EXAMPLE 1

In the same manner as in Example 1 except for using another carbon black (made by MITSUBISHI KASEI Co., Ltd. grade of #5B, size of 85 nm) instead of the carbon black in Example 1, a pressure-sensitive recording material was obtained.

COMPARATIVE EXAMPLE 2

In the same manner as in Example 1 except for using carbon powder of the size of 150 nm instead of the carbon black in Example 1, a pressure-sensitive recording material was obtained.

The results of testing the performances of each of the thus produced pressure-sensitive recording material by the methods as set forth below, are shown in Table 1 as compared to those of a commerciallized "carbonless recording paper" and a "carbon paper" produced by the present inventors according to the conventional method.

TABLE 1

| | Performances of Pressure-Sensitive Recording Paper | | | | | | |
|---|---|---|---|---|---|---|---|
| | Example | | | Comparative Example | | Reference Example | |
| | 1 | 2 | 3 | 1 | 2 | 1* | 2** |
| Coloured density of the image | 0.85 | 0.85 | 0.85 | 0.3 | 0 | 0.6 | 0.95 |
| Heat-resistance | 0.85*** | 0.85*** | 0.85*** | 0.3 | — | 0.6 | permeated to the under side |
| Light-resistance | 0.85 | 0.85 | 0.85 | 0.3 | — | 0.2 | 0.82 |
| Water-resistance | 0.85 | 0.85 | 0.85 | 0.3 | — | 0.1 | 0.95 |
| Alkali-resistance | 0.85 | 0.85 | 0.85 | 0.3 | — | 0 | 0.8 |
| Abrasion-resistance | without staining | without staining | without staining | without staining | | without staining | heavy staining |

Notes:
1*a commercialized carbonless recording paper
2**carbon paper
***without permeating The methods for determining the performances of the pressure-sensitive recording material including a sheet are as follows.

Colour density of the images: determined by McBeth Densitometer, the colour density of the image transcribed on another sheet by a printing pressure of a typewriter.

Heat-resistance: represented by the colour density of the images after heating the sheet for 3 hours at 150° C.

Light-resistance: represented by the colour density of the images after exposing the sheet for 6 hours to sun light.

Alkali-resistance: represented by the colour density of the images after leaving the sheet for 10 hours in gaseous $NH_3$.

Abrasion-resistance: by examination of the images with naked eyes after subjecting the sheet to an abrasion test under a pressure of 500 g by using an abrasion tester.

EXAMPLE 4

4-1: Preparation of two prepolymers

After adjusting the pH of 270 g of formalin by the addition of aqueous 2% solution of sodium hydroxide to 8.5, it was mixed with 70 g of melamine, and the mixture was brought into reaction while stirring the mixture at 70° C. Just after confirming the complete dissolution of melamine in the reaction mixture, 360 g of water were added to the reaction mixture, and the mixture was stirred for 3 min to obtain an aqueous solution of a prepolymer of melamine-formaldehyde resin (M6F prepolymer).

Separately, after adjusting the pH of 146 g of formalin by the addition of triethanol amine to 8.5, it was mixed with 60 g of urea, and the mixture was brought into reaction for 1 hour at 70° C. to prepare an aqueous solution of a prepolymer of urea-formaldehyde resin (U 1.8 F prepolymer).

4-2: Preparation of an oily dispersion

Into 670 g of diisopropylnaphthalene, 1 g of an oil-soluble dyestuff (OIL BLUE BOS, made by Orient Chem. Co., Ltd.) and 50 g of polystyrene (DICELASTYRENE® made by DAINIPPON INK Chem. Co., Ltd.) were dissolved, and in the obtained solution 78 g of carbon black (made by MITSUBISHI KASEI Co., Ltd., #33, size of 28 nm) was dispersed.

4-3: Microcapsulation

A mixture consisting of 280 g of M6F prepolymer (refer to 4-1), 140 g of U 1.8 F prepolymer (refer to 4-1), 56 g of the aqueous solution of the water-soluble cationic urea resin (Uramine® P-1500, made by URAMINE Ind. Co., Ltd.), 560 g of water and 28 g of triethanolamine was adjusted to pH of 5.2 by the addition of aqueous 10% solution of citric acid, and by admixing the mixture with 28 g of aqueous 10% solution of NEOPELEX ® No. 6 (sodium dodecylbenzenesulfonate, made by KAO-ATLAS Co., Japan) a solution named as A-liquid was obtained.

Into the thus prepared A-liquid, 700 ml of the oily dispersion (refer to 4-2) were dispersed so that the mean diameter of the oily dispersed particles is about 3–15 micrometers. The thus obtained aqueous dispersion was brought into reaction for 25 hours while gently stirring the aqueous dispersion and maintaining the aqueous dispersion at a temperature of 30° C., and after adding aqeous 10% solution of citric acid to the dispersion to adjust the pH of the dispersion to 3.0, the aqueous dispersion was continuously reacted under stirring to obtain a slurry of microcapsules encapsulating an oily dispersion of carbon black together with the adhesive and the coloured dyestuff.

To slurry of the thus obtained microcapsules, 5% by weight of polyvinyl alcohol (KURAREPOVAL ®105, made by KURARE Co., Ltd.) based on the slurry was added, and the mixture was applied onto a surface of a sheet of high quality paper of 50 g/m$^2$ at an applying rate of 3 g/m$^2$ (by weight of the microcapsules). By drying the thus coated sheet of paper, a pressure-sensitive recording paper according to the present invention was obtained.

EXAMPLE 5

In the same manner as in Example 4 except for using an oil-soluble coloured dyestuff, OIL BLUE II N instead of the oil-soluble coloured dyestuff, OIL BLUE BOS in Example 4, a pressure-sensitive recording paper was obtained.

EXAMPLE 6

In the same manner as in Example 4, a slurry of microcapsules was prepared and it was applied onto the surface of a sheet of synthetic paper (made by OJI OIL Chemical Synthetic Co., Ltd.) at an applying rate of 3 g/m$^2$ (by weight of the microcapsules), and by drying the sheet of synthetic paper, a sheet of pressure-sensitive recording synthetic paper was obtained.

COMPARATIVE EXAMPLE 3

In the same manner as in Example 4 except for using a carbon black (made by MITSUBISHI KASEI Co., Ltd., grade of #5B, size of 85 nm) of the larger size than that of the carbon black used in Example 4, a pressure-sensitive recording paper was obtained.

COMPARATIVE EXAMPLE 4

In the same manner as in Example 4 except for without using any carbon black, a slurry of microcapsules was prepared, and by applying the thus obtained slurry of microcapsules onto the surface of a sheet of high quality paper, a pressure-sensitive recording material was obtained.

The performances of the pressure-sensitive recording materials produced in Examples 4 to 6 and Comparative Examples 3 and 4 were tested and the results are shown in the following Table 2.

As are seen in Tables 1 and 2, the pressure-sensitive recording material is superior to those produced under the different conditions from those in the present invention and to those commerciallized concerning the performances thereof.

TABLE 2

Performance of Pressure-Sensitive Recording Paper

| | Example | | | Comparative Example | |
|---|---|---|---|---|---|
| | 4 | 5 | 6 | 3 | 4 |
| Density of the color of the recorded image | 0.95 | 0.97 | 0.96 | 0.3 | 0.5 |
| Continuity of the image | good | good | good | — | good |
| Clearness of the image | good | good | good | — | good |
| Light-resistance | 0.94 | 0.97 | 0.95 | — | 0.3 |
| Water-resistance | 0.95 | 0.97 | 0.96 | — | 0.5 |
| Alkali-resistance | 0.95 | 0.97 | 0.96 | — | 0.5 |
| Abrasion-resistance | no stain | no stain | no stain | — | no stain |
| Heat-resistance | 0.95 | 0.95 | 0.96 | — | 0.5 |

What is claimed is:

1. A pressure-sensitive recording material comprising a supporting material a face of which is coated with the microcapsules encapsulating minute particles of a pigment dispersed in a solution of an adhesive dissolved in a hydrophobic solvent as a core material of said microcapsules, the size of said particles of the pigment being less than 50 nm and the content of said pigment and said adhesive in the core material being less than 25% by weight and 1.5 to 30% by weight, respectively.

2. A pressure-sensitive recording material according to claim 1, wherein the weight ratio of said adhesive to said minute particles of a pigment in the core material is from 8:2 to 2:8.

3. A pressure-sensitive recording material according to claim 1, wherein said minute particles of a pigment are the minute particles of carbon.

4. A pressure-sensitive recording material according to claim 1, wherein said minute particles of a pigment in the core material is contained in the range of from 5 to 20% by weight based on the core material.

5. A pressure-sensitive recording material according to claim 1, wherein said adhesive is selected from the group consisting of polystyrenes, polyacrylates, polymethacrylates, low-molecular weight polyethylenes, ethylcellulose, natural rubbers and chloroprene rubbers.

6. A pressure-sensitive recording material according to claim 1, wherein said hydrophobic solvent is at least one selected from the group consisting of alkylbenzenes, alkylnaphthalenes, alkylbiphenyls, hydrogenated aromatic hydrocarbons and esters.

7. A pressure-sensitive recording material according to claim 1, wherein a material constituting the membrane of said microcapsules is polyurethane or amino resin.

8. A pressure-sensitive recording material according to claim 1 produced by applying the microcapsules encapsulating a core material further including an oil-soluble coloured dyestuff in addition to said minute particles of a pigment dispersed in said solution of an adhesive dissolved in a hydrophobic solvent, onto said supporting material.

9. A pressure-sensitive recording material according to claim 8, wherein the content of said oil-soluble coloured dyestuff in the core material is from 0.15 to 10% by weight based on said core material of said microcapsules.

10. A pressure-sensitive recording material according to claim 8, wherein said oil-soluble coloured dyestuff has an absorption band in the wave lengths of from 530 to 740 nm.

11. A pressure-sensitive recording material according to claim 10, wherein said oil-soluble coloured dyestuff is selected from the group consisting of anthraquinone dyes, triarylmethane dyes and phthalocyanine dyes.

12. A pressure-sensitive recording material according to claim 11, wherein said anthraquinone dye is SUDAN BLUE G EXTRA.

13. A pressure-sensitive recording material according to claim 11, wherein the phthalocyanine dye is ORIENT OIL BLUE BOS or ORIENT OIL BLUE II N.

14. A process for producing a pressure-sensitive recording material, comprising preparing microcapsules encapsulating minute particles of a pigment dispersed in a solution of an adhesive dissolved in a hydrophobic solvent, the size of said particles of the pigment being less than 50 nm and the content of said pigment and said adhesive in the core material being less than 25% by weight and 1.5 to 30% by weight, respectively, and applying a slurry of said microcapsules on the surface of a supporting material.

15. A process according to claim 14, comprising further dissolving an oil-soluble coloured dyestuff in said dispersed mixture as the core material of said microcapsules.

16. A process according to claim 14, wherein said minute particles of a pigment are minute particles of carbon.

17. A process according to claim 14, wherein the weight ratio of said adhesive to said minute particles of a pigment in the core material is from 8:2 to 2:8.

18. A process according to claim 14, wherein the content of said minute particles of a pigment in the core material is from 5 to 20% by weight based on the core material.

19. A process according to claim 14, wherein the content of said oil-soluble coloured dyestuff in the core material is from 0.15 to 10% by weight of the core material.

* * * * *